United States Patent [19]

Rogo et al.

[11] Patent Number: 4,718,819

[45] Date of Patent: Jan. 12, 1988

[54] VARIABLE GEOMETRY DEVICE FOR TURBINE COMPRESSOR OUTLET

[75] Inventors: Casimir Rogo, Mt. Clemens; Herman N. Lenz, Lambertville, both of Mich.

[73] Assignee: Teledyne Industries, Inc., Los Angeles, Calif.

[21] Appl. No.: 469,649

[22] Filed: Feb. 25, 1983

[51] Int. Cl.[4] ..... F04D 27/00

[52] U.S. Cl. ..... 415/149 R; 415/158

[58] Field of Search ..... 415/149 R, 160, 150, 415/158, 159, 157, 165

[56] References Cited

U.S. PATENT DOCUMENTS

| | | | |
|---|---|---|---|
| 2,996,996 | 8/1961 | Jassniker | 415/150 UX |
| 3,056,541 | 10/1962 | Foweraker | 415/149 X |
| 3,362,624 | 1/1968 | Endress | 415/158 UX |
| 3,362,625 | 1/1968 | Endress | 415/149 |
| 3,533,709 | 10/1970 | Willi | 415/160 X |
| 3,972,642 | 8/1976 | Fricke et al. | 415/158 X |
| 4,257,733 | 3/1981 | Bandukwalla et al. | 415/158 X |
| 4,378,194 | 3/1983 | Bandukwalla | 415/158 X |
| 4,403,914 | 9/1983 | Rogo et al. | 415/165 X |

FOREIGN PATENT DOCUMENTS

| | | | |
|---|---|---|---|
| 2354821 | 5/1974 | Fed. Rep. of Germany | 415/158 |
| 354887 | 7/1961 | Switzerland | 415/158 |

*Primary Examiner*—Robert E. Garrett
*Assistant Examiner*—Joseph M. Pitko
*Attorney, Agent, or Firm*—Gifford, Groh, VanOphem, Sheridan, Sprinkle and Dolgorukov

[57] ABSTRACT

A variable geometry device is provided for synchronous control of flow of fluid at the compressor inlet and outlet of a turbine engine. The turbine engine includes a support housing, a compressor contained within the support housing, a set of variable inlet guide vanes and a compressed air outlet in which a pair of spaced walls define an annular and radially extending diffuser passageway. The inner end of the diffuser passageway is open to the compressor outlet while the outer end of the diffuser passageway is open to the combustion chamber for the turbine engine. A plurality of circumferentially spaced diffuser vanes are mounted to one of the diffuser walls and protrude across the diffuser passageway. An annular recessed channel is formed around the opposite diffuser wall and an annular ring with a hollow cavity is mounted within the channel. A motor is operatively connected to this ring and, upon actuation, displaces the ring transversely across the diffuser passageway to variably restrict the diffuser passageway. In addition, a plurality of variable guide vanes are provided in the inlet to the compressor and varied in synchronism with the ring.

9 Claims, 4 Drawing Figures

VARIABLE GEOMETRY DEVICE FOR TURBINE COMPRESSOR OUTLET

BACKGROUND OF THE INVENTION

I. Field of the Invention

The present invention relates generally to variable geometry devices employed in turbine engines and, more particularly, to such a device for use in the diffuser passageway between the turbine engine compressor outlet and the combustion chamber.

II. Description of the Prior Art

A conventional turbine engine includes a support housing, a compressor having an outlet rotatably mounted within the support housing and a diffuser passageway which fluidly connects the compressor outlet to a combustion chamber also contained within the support housing. In many previously known turbine engines, the diffuser passageway is generally annular in shape having in its inner end open to the compressor outlet so that the air flow through the diffuser passageway is generally radially outward. In addition, many of the previously known turbine engines include diffuser vanes extending across the diffuser passageway to aerodynamically control the flow of compressed air from the compressor and to the combustion chamber.

Many turbine engine applications require that the turbine engine be operated over a broad range of operating conditions. These different operating conditions in turn entail different air flow and pressure delivery requirements. Moreover, it is desirable to maintain high turbine engine performance, and thus turbine engine efficiency, at all of the operating conditions which, in turn, avoids surge, cavitation and other engine instabilities.

One previously known method of broadening the flow capacity characteristics in the diffuser passageway is to use variable geometry engine components. In the case of centrifugal compressors, the desired variable geometry for the diffuser assembly is typically accomplished by varying the angle of the diffuser vanes in the diffuser passageway.

The previously known pivoted diffuser vanes, however, have not proven wholly satisfactory in use to vary the diffuser geometry. One disadvantage of this method results from the leakage losses which occur in the diffuser assembly around the pivoted diffuser vanes and into the support housing. These clearance losses are further amplified due to the large openings in the diffuser walls which are required to compensate for thermal distortion and thermal expansion.

A still further disadvantage of the use of pivoted diffuser vanes to vary the aerodynamic geometry of the diffuser passageway is that it is difficult to accurately pivot all of the diffuser vanes to the same angle due to mechanical back-lash and mechanical play. Unwanted and undesired turbulences result when the diffuser vanes are positioned at different angles.

Patent related to varying the flow with a movable side wall diffuser are described in the following patents: U.S. Pat. No. 2,739,782 to White; U.S. Pat. No. 2,996,966 to Jassniker; and French Pat. No. 1,208,697—Societe dite: Sulzer Freres.

These inventions relate to varying the exit diffuser flow area alone and unless the inlet flow area is also simultaneously changed, the efficiency, flow range and pressure ratio is adversely affected. In contrast to the above-described prior arrangements, the present invention contemplates improvements by synchronized area changes at both the inlet and exit of the compressor. In the embodiment of the invention the movable exit diffuser wall will also provide for static pressure equalization at the vane ends by allowing flow from the impeller exit to enter an annular chamber receiving the vanes through vane slots. It is known that interconnecting the vane entrances and equalizing the static pressure leads to increases of compressor range as described in the invention of U.S. Pat. No. 4,121,389 to Perrone et al. The reference invention contemplates pressure equalization to closed chambers on both sides of the diffuser by small openings or slots oriented to lie in planes normal to the flow. In contrast to U.S. Pat. No. 4,121,389 which contemplates wall to wall pressure equalization, the present invention has one continuous slot in the chambered wall for each vane and results in an end static pressure equalization from vane pressure side to suction side resulting in a different mechanism to improve surge and flow range performance.

SUMMARY OF THE PRESENT INVENTION

The present invention provides for a mechanism for equalizing the pressure distribution in the end walls of a compressor diffuser and combines a mechanism for simultaneous change in inlet and exit compressor area to overcome previously known undesirable characteristics and, therefore, lead to improved engine efficiencies.

In brief, in the present invention, two spaced walls in the support housing form an annular diffuser passageway having its inner end open to the compressor outlet. The outer end of the diffuser passageway is fluidly connected to the combustion chamber for the turbine engine. In addition, a plurality of circumferentially spaced diffuser vanes are secured to one support housing wall and extend transversely or axially across the diffuser passageway.

An annular channel is formed around the entire circumfery of the other diffuser wall. Thereafter a ring with an annular cavity is mounted within this channel and moving means are attached to the ring for moving the ring between a retracted and extended position.

In its retracted position, the ring is nested within the channel so that one face of the ring is substantially flush with the wall of the diffuser passageway. Conversely, in its extended position, the ring protrudes into and restricts the diffuser passageway.

In the preferred form of the invention, the ring has a plurality of circumferentially spaced slots so that one slot registers with and receives one diffuser vane therein. Thus, the diffuser vane geometry remains fixed regardless of the position of the ring. This slot also connects to an annular closed chamber which acts as a static pressure equalization cavity to equalize diffuser vane end wall pressures to promote broader and improved surge characteristics.

Axial movement of the diffuser ring is effected by a plurality of externally threaded pins secured to the ring each of which cooperate with an internally threaded gear so that rotation of the gear by a motor axially displaces the ring.

Variable inlet guide vanes attached to the compressor housing provide for inlet flow throttling. The inlet guide vanes are connected to the movable diffuser side wall through adjustable pins that engage a ring gear that in turn meshes with the diffuser ring actuating gears. The mechanism thus provides a unique relationship of inlet guide vane position to exit ring diffuser position (or area) and synchronization of movement.

BRIEF DESCRIPTION OF THE DRAWING

A better understanding of the present invention will be had upon reference to the following detailed description when read in conjunction with the accompanying drawing wherein like reference characters refer to like parts throughout the several views, and in which.

DETAILED DESCRIPTION OF A PREFERRED EMBODIMENT OF THE PRESENT INVENTION

Figure 1:
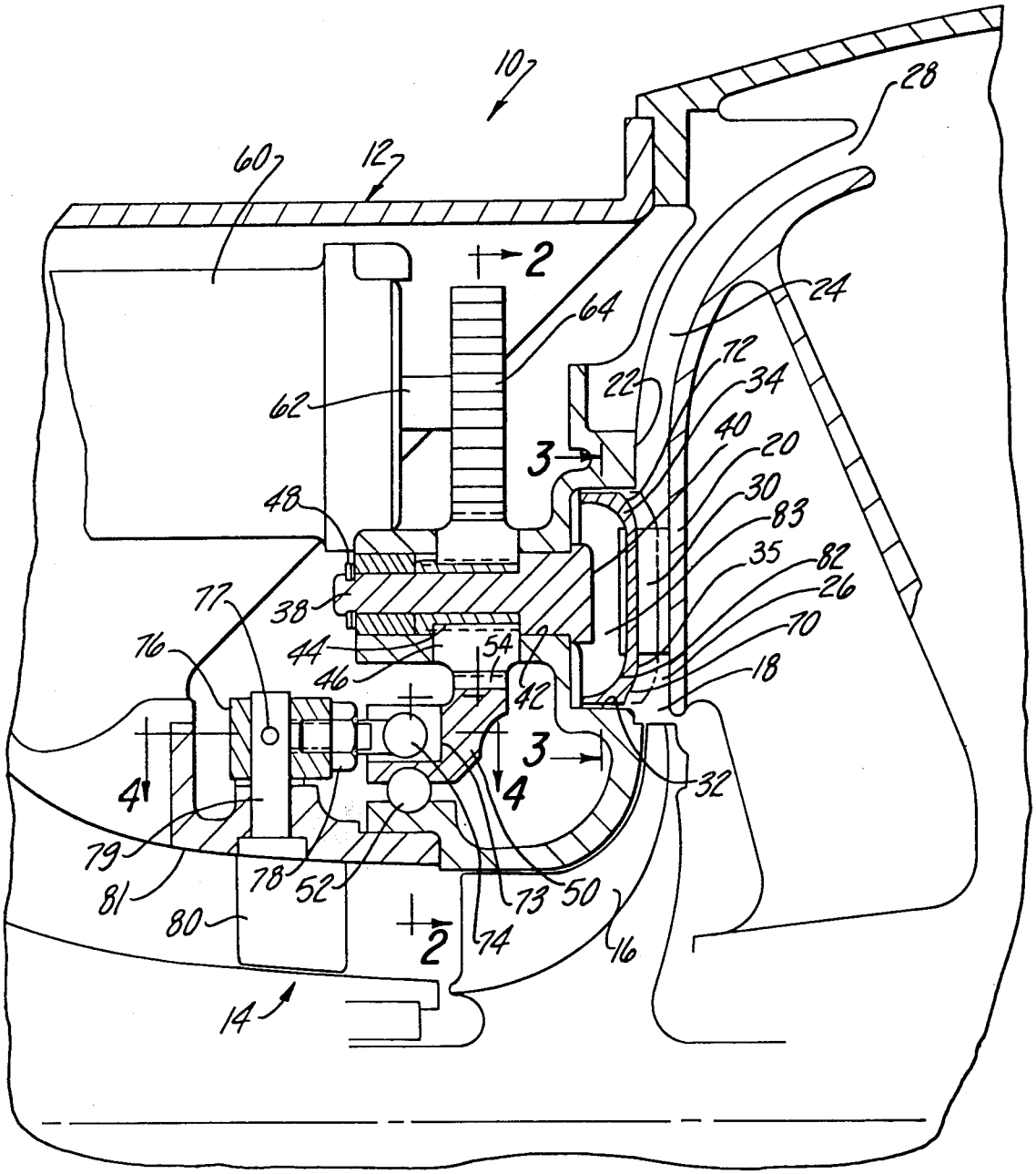
FIG. 1 is a fragmentary sectional view illustrating a preferred embodiment of the variable geometry device of the present invention.

With reference first to FIG. 1, a portion of a turbine engine 10 is thereshown and comprises a support housing 12 in which an air compressor means 14 is rotatably mounted. The air compressor means 14 also includes a stage 16 open to a compressed air outlet 18.

The support housing 12 includes a first annular diffuser wall 20 and a second annular diffuser wall 22 which, together, form an annular diffuser passageway 24 within the support housing 21. The inner end 26 of the diffuser passageway 24 is open to and registers with the compressor outlet 18 while the outer end 28 of the diffuser passageway 24 is open to a combustion chamber (not shown). Thus, in the well known fashion, the diffuser passageway 24 fluildly connects the compressor outlet 18 with the combustor chamber of the turbine engine 10.

Figure 3:
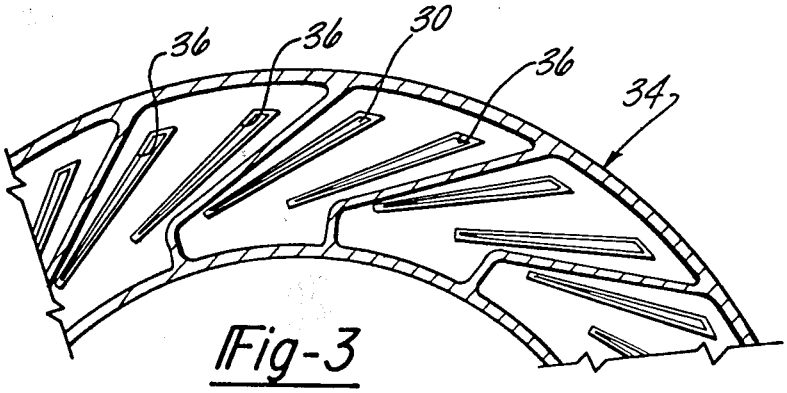
FIG. 3 is a fragmentary sectional view taken substantially along line 3—3 in FIG. 1.

With reference now to FIGS. 1 and 3, a plurality of circumferentially spaced diffuser vanes 30 are secured to the diffuser wall 20 and extend entirely axially across the diffuser passageway 24. These diffuser vanes 30 are of a fixed geometry and aerodynamically shape the air flow from the compressor outlet 18 and to the combustion chamber.

Still referring to FIGS. 1 and 3, an annular recessed channel 32 having a generally rectangular cross sectional shape is formed around the entire circumfery of the diffuser wall 22. A ring 34 having a front face 35 and back face 82 forming chamber 83 is then positioned within the channel 32 so that the ring 34 also extends entirely around the diffuser passageway 24. The ring 34 is of a rigid construction and is preferably formed by casting. In addition, the ring 34 has a plurality of circumferentially spaced slots 36 (FIG. 3) formed through it so that one slot 36 registers with and receives one diffuser vane 30 therein and a clearance space between the vane 30 and slot 36 fluidly connects chamber 83 to diffuser passageway 24.

Figure 2:
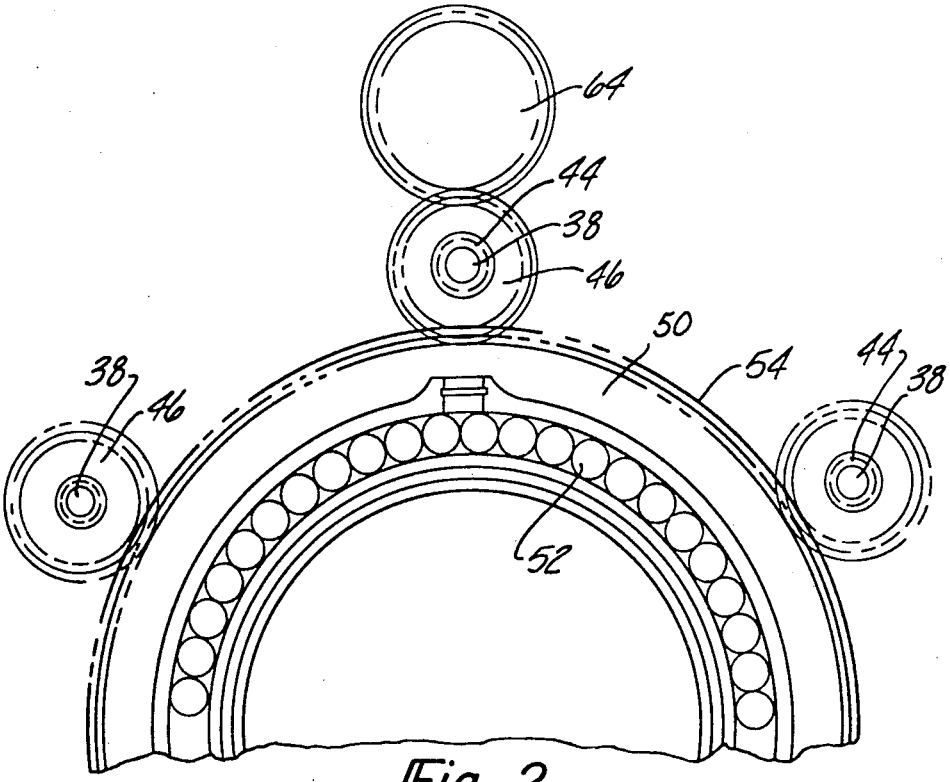
FIG. 2 is a fragmentary sectional view taken substantially along line 2—2 in FIG. 1.

With reference now to FIGS. 1 and 2, a plurality of circumferentially spaced pins 38 are secured at one end 40 to the ring 34 and each pin extends axially outwardly through an opening 42 in the base of the channel 32. The pins 38 furthermore include an externally threaded portion 44 along their length and the pins 38 can be either integrally formed with the ring 34 or separately fabricated and secured to the ring 34. In addition, the pins 38 are free to axially slide in the opening 42 and, in doing so, axially displace the ring 34 transversely across the diffuser passageway 24.

In order to control the axial position of the pin 38, and thus the ring 34, an internally threaded pinion 46 is threadably attached to the threaded portion 44 of each pin 38. Each pinion 46 is axially constrained with respect to the support housing 12 by a retainer 48 so that rotation of the pinion 46 axially displaces the pin 38 and the ring 34 due to the threaded connection between each pinion 46 and its associated pin 38.

A gear ring 50 is rotatably mounted to the support housing 12 by a ball bearing assembly 52 so that the gear ring 50 rotates concentrically around the compressor assembly 14. The teeth 54 of the gear ring 50 mesh with the inner radial ends of the pinions 46.

With reference still to FIGS. 1 and 2, a motor 60 is contained within the support housing 12 and includes an output shaft 62 on which a drive gear 64 is secured. The drive gear 64, in turn, is in mesh with one of the pinions 46. The motor 60 is a reversible motor and is of any conventional construction, such as an electric or hydraulic motor.

With reference now particularly to FIG. 1, in operation, rotation of the drive gear 64 by the motor 60 rotatably drives one of the pinions 46. This, in turn, rotates the gear ring 50 on its ball bearing assembly 52 in dependence upon the direction of rotation of the motor 60. Since the gear ring 50 is in mesh with each of the pinions 46, all of the pinions 46 rotate in unison with each other.

The rotation of the pinions 46 axially displaces the pins 38 with their attached ring 34 due to the threaded engagement between each pinion 46 and its associated pin 38. Thus, the ring 34 moves transversely across the diffuser passageway 24 between a retracted position, shown in solid line in FIG. 1, and an extended position, shown in phantom line in FIG. 1. In its retracted position, the ring 34 is nested within the channel 32 so that its front face 35 is substantially flush with the diffuser wall 22. Conversely, with the ring 34 in its extended position, the ring 34 restricts the diffuser passageway 24 without altering the geometry of the diffuser vanes 30 due to the sliding engagement of the vanes 30 in the ring slots 36.

The provision of the circumferentially spaced pins 38 prevents the ring 34 from tilting and ensures that all portions of the ring 34 protrude into the diffuser passageway 24 by the same amount.

As is shown in FIG. 1, both the inner radial end 70 and outer radial end 72 of the ring 34 are tapered inwardly toward the diffuser side wall 22. Thus, with the ring 34 in its extended position, both the inner radial and outer radial ends 70 and 72 of the ring 34 taper toward and meet the diffuser side wall 22. The tapered portions 70 and 72 of the ring 34 are designed to minimize air turbulence through the diffuser passageway 24 when the ring 34 is in its extended position.

Figure 4:
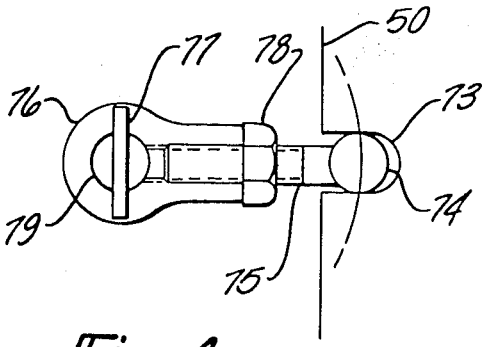
FIG. 4 is a longitudinal sectional view taken substantially along line 4—4 in FIG. 1.

With reference to FIGS. 1 and 4, a plurality of circumferentially spaced inlet guide vanes 80 are positioned within the inlet passage to the stage 16 of the compressor so that the inlet vanes 80 control the inlet air flow to the compressor state 16. Each inlet guide vane 80 is rotatably mounted to a vane housing 81 by a pivot shaft 79 so that varying the rotational position of the shaft 79 varies the aerodynamic geometry of the inlet vanes 80. A pivot arm 76 is secured to the pivot shaft 79 by a locating pin 77 and the pivot arm 76 is internally threaded to receive externally threaded pivot pin 75. The pivot pin 74 is locked in position on pivot arm 76 by locking nut 78. The opposite end of the pivot pin 74 is spherical in shape and is positioned within a slot 73 in the ring gear 50.

In this preferred embodiment of the invention, the inlet guide vanes 80 are located or angled in a specific and predetermined relative position with respect to the diffuser wall ring 34. Any movement of the ring 34 by the actuating motor 60 and drive pinions 64 and threaded gear 46 is also simultaneously and synchronously transmitted to the guide vanes 80 by meshed pinions 46, ring gear 50, ring gear slots 73 and pivot arm 76. Varying the inlet vane 80 geometry in synchronism with the position of the ring 34 results in improved surge and stall characteristics for the engine 10.

The threaded pin 74 and nut 78 also provide a means for adjusting the length of the pivot arm 76. Adjustment of the length of the pivot arm 76 varies the angular position of the inlet vanes 80 with respect to the position of the gear ring 50.

From the foregoing, it can be seen that the present invention provides a novel construction for varying the aerodynamic geometry of the diffuser passageway in a turbine engine without varying the geometry or angle of the diffuser vanes. Further the invention provides for simultaneous and synchronized variation of inlet guide vane area with the exit diffuser area for improved flow control and performance. Moreover, the device of the present invention is compact in construction and virtually fail safe in operation.

A still further advantage of the present invention is that leakage losses, a major disadvantage of the previously known pivotal diffuser vane constructions, is virtually entirely eliminated. Any leakage through the ring slots 36 is simply returned to the diffuser air flow and ultimately to the combustion chamber. Further, the ring slots 36 are uniquely connected to an annular plenum which serves the purpose of equalizing static pressures around the diffuser vane ends and ultimately reduces stalling the surge tendencies of the engine.

Having described our invention, however, many modifications thereto will become apparent to those skilled in the art to which it pertains without deviation from the spirit of the invention as defined by the scope of the appended claims.

We claim:

1. A variable geometry compressor assembly for a turbine engine comprising:

a support housing, a compressor means contained within the support housing and having a compressed air inlet and compressed air outlet, said support housing having a pair of spaced diffuser walls which form an annular diffuser passageway having its inner end open to said compressed air outlet, said diffuser passageway having an annular recessed channel formed along one diffuser wall, a ring mounted in said channel, means for moving said ring transversely across said passageway between a retracted position in which said ring is nested within said channel and an extended position in which said ring protrudes into and restricts said diffuser passageway, a plurality of inlet guide vanes and means for pivotally mounting said inlet guide vanes relative to said support housing at circumferentially spaced positions in said compressd air inlet, a plurality of circumferentially spaced diffuser vanes secured to the other diffuser wall and protruding through said diffuser passageway, wherein said ring includes a plurality of closed slots which register with and slidably receive said diffuser vanes, wherein said moving means comprises a gear ring rotatably mounted to said housing and means for selectively rotatably driving said gear ring and wherein said pivoting means comprises a plurality of rods, each rod secured at one end to one inlet guide vane, means for pivotally securing the other ends of said rods to said gear ring, and means for adjusting the length of each rod and for locking each such rod at the adjusted length.

2. The invention as defined in claim 1 and further comprising a plurality of threaded and circumferentially spaced pins secured to said ring.

3. The invention as defined in claim 1 and further comprising a plurality of circumferentially spaced pins secured to and extending outwardly from a side of said ring and through an opening in said channel, each pin having an external threaded portion along its length, and wherein said moving means comprises a plurality of threaded members, each threaded member threadably engaging one of said pin threaded portions and means for selectively rotating said threaded members in synchronism.

4. The invention as defined in claim 3 wherein each threaded member comprises an internally threaded pinion and wherein said rotating means further comprises a gear ring rotatably mounted to said support housing and in mesh with each pinion, a drive gear in mesh with one of said pinions and motor means for rotatably driving said drive gear.

5. The invention as defined in claim 4 wherein said gear ring is rotatably connected to said support housing by a plurality of balls entrapped between a groove on the housing and a groove on an inner radius of the ring gear.

6. The invention as defined in claim 1 wherein a center of a face of said ring is substantially flush with said one diffuser wall when said ring is in its retracted position.

7. The invention as defined in claim 6 wherein said ring includes a tapered portion adjacent both an inner radial end and an outer radial end of said ring which tapers from said ring face and toward said one diffuser wall.

8. The invention as defined in claim 7 wherein the inner and outer radial ends of said face of said ring substantially register with said one diffuser wall when said ring is in said extended position.

9. The invention as defined in claim 1 and comprising a cavity formed in said ring, said cavity being open to said channel and said slots being open to said cavity.

* * * * *